United States Patent [19]

Toy et al.

[11] 4,409,174

[45] Oct. 11, 1983

[54] METHOD FOR BATCH PRODUCTION OF ISOSTATICALLY PRESSED CALCIUM POWDER DISCS

[75] Inventors: Albert Toy, Gardena; Louis L. Constantino, Placentia; Donald B. Evans, Redondo Beach, all of Calif.

[73] Assignee: The United States of America as represented by the Secretary of the Army, Washington, D.C.

[21] Appl. No.: 334,099

[22] Filed: Dec. 24, 1981

[51] Int. Cl.[3] ..... B28B 3/00

[52] U.S. Cl. ..... 264/313; 425/405 H

[58] Field of Search ..... 425/405 H; 264/313, 264/111

[56] References Cited

U.S. PATENT DOCUMENTS

| | | | |
|---|---|---|---|
| 3,313,871 | 4/1967 | Vogel et al. | 425/405 H |
| 3,558,962 | 1/1971 | Reash | 313/180 |
| 3,577,635 | 4/1971 | Bergman et al. | 264/313 |
| 3,956,452 | 5/1976 | Saito | 425/405 H |

*Primary Examiner*—Lorenzo B. Hayes

*Attorney, Agent, or Firm*—Robert P. Gibson; Anthony T. Lane; James T. Deaton

[57] ABSTRACT

A method for low cost mass production of isostatically pressed powder calcium discs by placing a multiplicity of molds with powdered calcium thereon in a mother bag that is later sealed and pressed isostatically to press the calcium powder relative to its respective mold.

5 Claims, 3 Drawing Figures

METHOD FOR BATCH PRODUCTION OF ISOSTATICALLY PRESSED CALCIUM POWDER DISCS

The invention described herein was made in the course of or under a contract or subcontract thereunder with the Government and may be manufactured, used, and licensed by or for the Government for governmental purposes without the payment to us of any royalties thereon.

BACKGROUND OF THE INVENTION

In chemical lasers, there is a need for chemical pumping material or getter material for absorbing the spent laser gases. Calcium is a chemical pump or getter material that is commonly used, however, this material must be supported in some way to be effectively used for the chemical pump or getter material. Since calcium must be kept in a dry atmosphere, and due to other support needs for this material, there is need for producing plates, discs, or wafers that contain calcium at low cost.

Therefore, it is an object of this invention to provide a simple method by which a multiplicity of reinforced calcium powder discs can be produced simultaneously as a batch to reduce the cost of producing the reinforced calcium powder discs.

Another object of this invention is to provide a method which can be carried out with reduced labor cost due to a multiplicity of the support structures or molds with the calcium thereon being placed in a common bag or housing and being adapted to be isostatically pressed simultaneously.

Still another object of this invention is to provide a method in which incapsulated polyvinyl chloride aluminum plate molds provide the stiffness for flatness control and elastomeric materials over the entire mold surfaces to effect an isostatic condition for more uniform densification of the calcium powder.

Yet another object of this invention is to provide a method in which a truer isostatic pressing results in better disc quality such as uniform density and mechanical stability.

Other objects and advantages of this invention will be obvious to those skilled in this art.

SUMMARY OF THE INVENTION

In accordance with this invention, a method for producing a batch of isostatically pressed and calcium powder reinforced discs at low cost including providing a flexiable mother bag such as a polyvinyl chloride bag that has a cylinderical shape. A reinforced mold with a multiplicity of finger projections and with a reinforcing metal screen inserted over the fingers is first placed in a mother bag. Powdered calcium is then loaded on the mold around the fingers. Next, another reinforced mold is placed over the first calcium loaded mold and then loaded with calcium powder. This process is repeated until the mother bag is filled with multiple layers of the molds and when the mother bag is full, a top disc is placed over the last loaded mold and a solid cap is sealed relative to the mother bag such as by tape. The loading of the mother bag is carried out in a dry box since the calcium must be handled in a dry inert atomsphere. The mother bag with the calcium loaded modules are then placed in a pressure vessel that contains an inert gas such as argon and the pressure is brought up to compress the mother bag and the ingredients therein to produce cold isostatic pressing of the calcium on the mold and relative to the screen that is mounted on the mold module. After pressing, the mother bag is opened and the mold modules are removed and finally the calcium that is pressed onto the screen is removed in a conventional manner from the plastic mold.

DESCRIPTION OF THE PREFERRED EMBODIMENT

Figure 1:
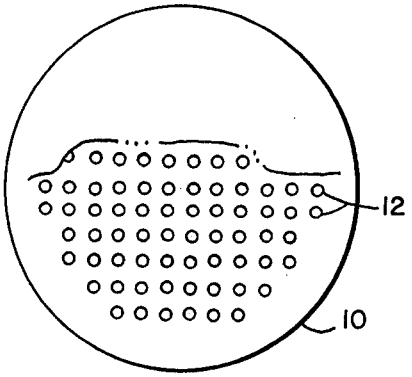
FIG. 1 is a top view of the disc mold in accordance with this invention.
Figure 2:
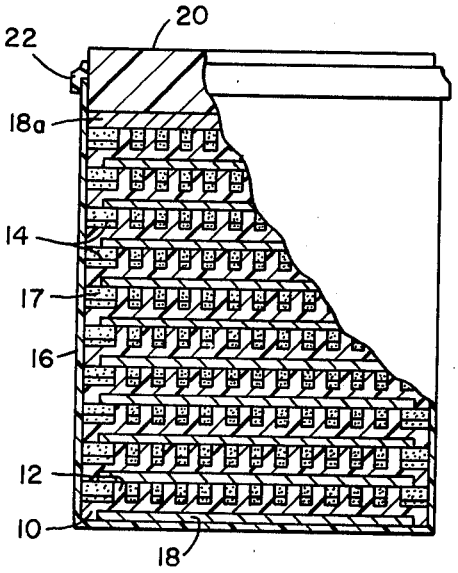
FIG. 2 is a side view with a portion of the container cutaway illustrating the stacking of the molds in the mother containing before pressing.
Figure 3:
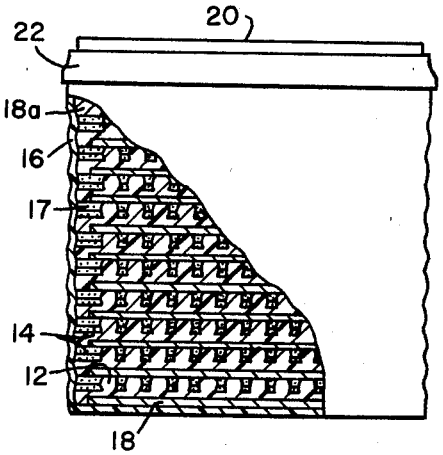
FIG. 3 is a side view with a portion of the container cutaway illustrating the container and the molds in the pressed condition.

Referring now to FIG. 1, in accordance with the method of this invention, a mold 10 preferably made of polyvinyl chloride with a multiplicity of upward projecting circular fingers 12, and reinforced at its base with a metal plate 18 such as aluminum, is provided. A steel mesh 14 (see FIG. 2) is inserted over the fingers of the mold to provide a support structure for calcium. A mother bag 16 of a circular shape and preferably of polyvinyl chloride or other equivalent flexible material is used for having a multiplicity of the loaded molds placed therein for pressing. Bag 16 is loaded by first placing mold 10 with its screen 14 mounted over fingers 12 into bag 16. After mold 10 has been placed in bag 16, the mold is loaded with a predetermined amount of calcium powder 17 on mold 10 and around fingers 12. The loaded calcium powder will also be above and below reinforcing mesh 14. A second mold 10 is then mounted in bag 16 and loaded in the same manner as the first bag. This process is repeated until the bag is full of molds 10 that are loaded with powdered calcium 17. Finally when bag 16 is full, a top plate 18*a*, such as an aluminum plate, is placed over the top mold and a solid cover or cap 20 of plastic material is connected to the top of bag 16 and sealed relative thereto such as by flexible adhesive type tape 22. During filling of bag 16 with the layers of molds, this operation is carried out in a dry box and inert atmosphere as is required in the handling of calcium powder. Once mother bag 16 is filled and sealed as illustrated in FIG. 2, the filled mother bag 16 is ready for cold isostatic pressing. This is accomplished by placing filled mother bag container 16 in a pressure vessel that has an inert gas atmosphere such as argon and the pressure within the container is gradually increased from ambient temperature and atmospheric pressure to about 1,250 psi and held for about 10 minutes at 1,250 psi to cause calcium powder 17 that has been placed on mold 10 and around fingers 12 of each of the molds to be isostatically pressed onto steel screen 14 of each of molds 10. The filled mother bag as illustrated in FIG. 3 illustrates the physical arrangement of the multiple discs and molds is an isostatically pressed condition to attempt to illustrate how the calcium is isostatically pressed onto screens 14. During this pressing, top cap 20 moves down and acts like a piston to compress and bulge fingers 12 radially outwardly. When the pressure is removed, fingers 12 assume their original shape. The radial bulging of fingers 12 during the pressing operation aids in being able to remove the pressed calcium disc from the mold and fingers when the disc is separated. After isostatic pressing molds 10 with isostatically pressed calcium thereon are removed from mother bag container 16 and mold 10 with fingers 12 is separated from isostatically pressed calcium 17 in a conventional manner leaving isostatically pressed calcium 17 mounted on steel mesh 14. In the isostatic pressing of the multiplicity of molds 10 in mother bag 16, it is invisioned from experience that upon the application of gas pressure to mother bag 16, the pressure is transmitted isostatically inward from module to module maintaining essentially an isostatic condition through the elastomeric material medium. If desired, mother bag 16 can be placed in another thin plastic bag before the pressing operation.

Table I produced hereinbelow illustrates and makes comparison of the isostatic pressing of a single mold with calcium thereon as opposed to a multiplicity of molds with calcium thereon that are pressed in a mother bag in accordance with this invention. As can be seen, utilizing applicants' method one is able to press a multiplicity of calcium discs simultaneously in a mother bag and produce as good a quality of isostatically pressed calcium discs as can be produced when pressing only one mold at a time. This multi mold method has reduced the labor cost for producing a reinforced calcium disc produced by applicants' method to about 1/20 of the labor cost for producing a reinforced calcium disc by the single disc/single mold method.

TABLE I

Fabrication Data of Perforated Discs
(Comparison of Single Mold and Multiple Mold Methods)

| Disc No. | Mold System | Screen Wt. (Gms.) | Pressure (P.S.I.) | Time (Min.) | Calcium Wt. Grams | Thickness (Inches) | Density (GM./CC.) | O.D. Inches (Nominal) | Perforated Diam. Inches (Nominal) |
|---|---|---|---|---|---|---|---|---|---|
| 52 | S | 16.8 | 1250 | 10 | 39.6 | .194 | .41 | 7.1 | .235 |
| 55 | S | 17.0 | 1250 | 10 | 39.1 | .193 | .41 | 7.1 | .235 |
| 58A | M-1 | 16.45 | 1250 | 10 | 39.95 | .192 | .45 | 7.1 | .235 |
| 62 | M-1 | 17.33 | 1250 | 10 | 40.02 | .196 | .44 | 7.1 | .235 |
| 68 | M-1 | 16.56 | 1250 | 10 | 38.24 | .198 | .42 | 7.1 | .235 |
| 59A | M-1 | 17.23 | 1250 | 10 | 38.27 | .192 | .43 | 7.1 | .235 |
| 60 | M-1 | 17.25 | 1250 | 10 | 39.15 | .197 | .43 | 7.1 | .235 |
| 64 | M-2 | 17.57 | 1250 | 10 | 40.33 | .181 | .48 | 7.1 | .235 |
| 65 | M-2 | 17.16 | 1250 | 10 | 40.54 | .188 | .47 | 7.1 | .235 |
| 69 | M-2 | 16.29 | 1250 | 10 | 39.96 | .185 | .47 | 7.1 | .235 |
| 61 | M-2 | 17.11 | 1250 | 10 | 39.79 | .190 | .45 | 7.1 | .235 |
| 67 | M-2 | 16.36 | 1250 | 10 | 40.54 | .187 | .47 | 7.1 | .235 |

*S=Single Mold Normal Process
M-1=Multiple Mold "Mother" Bag Batch No. 1
M-2= Multiple Mold "Mother" Bag Batch No. 2

We claim:

1. A method for batch production of low cost isostatically pressed powder calcium discs comprising placing one at a time a multiplicity of molds with calcium powder thereon in a bag of flexible material until said bag is filled with a stack of said molds one on top of the other and contiguous, sealing said bag with a top cap, isostatically pressing said bag with said molds contained therein to isostatically press the powder calcium on said molds, removing said molds with the isostatically pressed calcium disc thereon from said bag and subsequently removing the formed discs from said molds.

2. The method as set forth in claim 1, wherein a first mold is placed in said bag and the powdered calcium loaded thereon, a second mold is placed in the bag and loaded and said process of placing and loading the molds is repeated until the bag is filled with said calcium-laden molds.

3. The method as set forth in claim 2, wherein said bag containing the calcium-laden molds is placed in a pressure vessel containing an inert gas and the pressure of said inert gas is gradually increased from atmospheric pressure up to about 1250 psi and maintained for about 10 minutes.

4. The method as set forth in claim 3, wherein metal reinforcing means is placed between plastic means of the mold upon which said calcium powder is loaded before said calcium powder is loaded thereon.

5. The method as set forth in claim 4, wherein each of said molds has a multiplicity of upward projecting circular fingers about which said powdered calcium is loaded and wherein said fingers are deformed and spread radially when said bag is isostatically pressed to aid in removal of said calcium discs from each mold.

* * * * *